US009133665B2

(12) United States Patent
Collares

(10) Patent No.: US 9,133,665 B2
(45) Date of Patent: Sep. 15, 2015

(54) DETECTING AND MITIGATING BOREHOLE DIAMETER ENLARGEMENT

(71) Applicant: HALLIBURTON ENERGY SERVICES, INC., Houston, TX (US)

(72) Inventor: Andre Collares, Belvedere Belo Horizante-MG (BR)

(73) Assignee: Halliburton Energy Services, Inc., Houston, TX (US)

( * ) Notice: Subject to any disclaimer, the term of this patent is extended or adjusted under 35 U.S.C. 154(b) by 332 days.

(21) Appl. No.: 13/711,328

(22) Filed: Dec. 11, 2012

(65) Prior Publication Data

US 2013/0098685 A1 Apr. 25, 2013

Related U.S. Application Data

(63) Continuation of application No. PCT/US2011/040111, filed on Jun. 11, 2011.

(51) Int. Cl.

| | |
|---|---|
| ***E21B 7/00*** | (2006.01) |
| ***E21B 47/08*** | (2012.01) |
| ***E21B 17/20*** | (2006.01) |

(52) U.S. Cl.

CPC ..... *E21B 7/00* (2013.01); *E21B 17/206* (2013.01); *E21B 47/08* (2013.01)

(58) Field of Classification Search

CPC ..... E21B 47/08; E21B 45/00; E21B 44/00; E21B 7/00; E21B 17/206; G01B 7/13

See application file for complete search history.

(56) References Cited

U.S. PATENT DOCUMENTS

| | | | |
|---|---|---|---|
| 4,599,904 | A | 7/1986 | Fontenot |
| 4,791,619 | A | 12/1988 | Liu |
| 2005/0284659 | A1 | 12/2005 | Hall et al. |
| 2009/0166031 | A1 | 7/2009 | Hernandez |

FOREIGN PATENT DOCUMENTS

| | | | | |
|---|---|---|---|---|
| CA | 2270637 | A1 | 11/1999 | |
| CA | 2411603 | A1 | 6/2003 | |
| GB | 2460096 | A * | 11/2009 | ..... E21B 47/08 |

OTHER PUBLICATIONS

International Application No. PCT/US2011/040111 Search Report and Written Opinion dated Jun. 11, 2011.

Daniel Ask et al., "Detection of Potential Borehole Breakouts in Boreholes KFM01A and KFM01B," Forsmark Site Investigation, pp. 1-60, Dec. 2007.

Canadian Intellectual Property Office, Office Action dated May 9, 2014, for Canadian Application No. 2,802,320, filed Dec. 11, 2012.

* cited by examiner

*Primary Examiner* — Yong-Suk (Philip) Ro

(57) ABSTRACT

Borehole diameter enlargement occurs while drilling, circulating, reaming, and/or cleaning the borehole, and such borehole diameter enlargements can be detrimental to proper tripping of a drillstring or running of a casing string. Methods and systems are disclosed for detecting or measuring borehole diameter enlargement, diagnosing the cause of the borehole diameter enlargement, and potentially mitigating the borehole diameter enlargement based on the diagnosed and identified causes.

12 Claims, 9 Drawing Sheets

1
2
3
4
9
8
15
5
17
16
10
11
13
18
7
6

DETECTING AND MITIGATING BOREHOLE DIAMETER ENLARGEMENT

CROSS-REFERENCE TO RELATED APPLICATIONS

This application is a continuation of and claims priority to International Patent Application No. PCT/US2011/040111, filed Jun. 11, 2011, entitled "Detecting and Mitigating Borehole Diameter Enlargement".

BACKGROUND

During the drilling of oil and gas wells, unpredictable and unwanted borehole diameter enlargement may occur in addition to the primary borehole drilling. Specific intervals or locations of borehole diameter enlargement, or "out-of-gauge" portions, are undesirable discontinuities in the overall "in-gauge" character of a good borehole. Borehole enlargement can cause problems when tripping or pulling the drillstring out of the borehole, and when running casing. Sections of borehole enlargement can create "tight" hole conditions for the drillstring or casing, wherein the borehole is closed off to proper axial movement of the drillstring or casing, which result in operational time loss during a single trip of the drillstring or casing string. For example, borehole diameter enlargement can cause the loss of one to two days of expensive rig time due to the interruptions in tripping or running. Extended reach and/or high-angle wells are susceptible to localized borehole enlargement, and the problems created thereby are exacerbated in such wells.

Possible causes of hole enlargement include the mechanical and hydraulic damage from the bottomhole assembly (BHA) and mud across the BHA, insufficient mud weight, excessive pressure or hydraulic horsepower per square inch (HSI) drop on the drill bit, excessive flow rate and mud viscosity, drillstring vibration, and others.

It is difficult, in the field, to identify the cause of drillstring tripping or casing running problems, and in particular correlating these problems specifically with borehole enlargement. Further, after borehole enlargement is identified, it is difficult to determine the cause of the enlargement. The present disclosure overcomes these and other limitations of the prior art.

BRIEF DESCRIPTION OF THE DRAWINGS

For a detailed description of exemplary embodiments of the invention, reference will now be made to the accompanying drawings in which.

DETAILED DESCRIPTION

Figure 1:
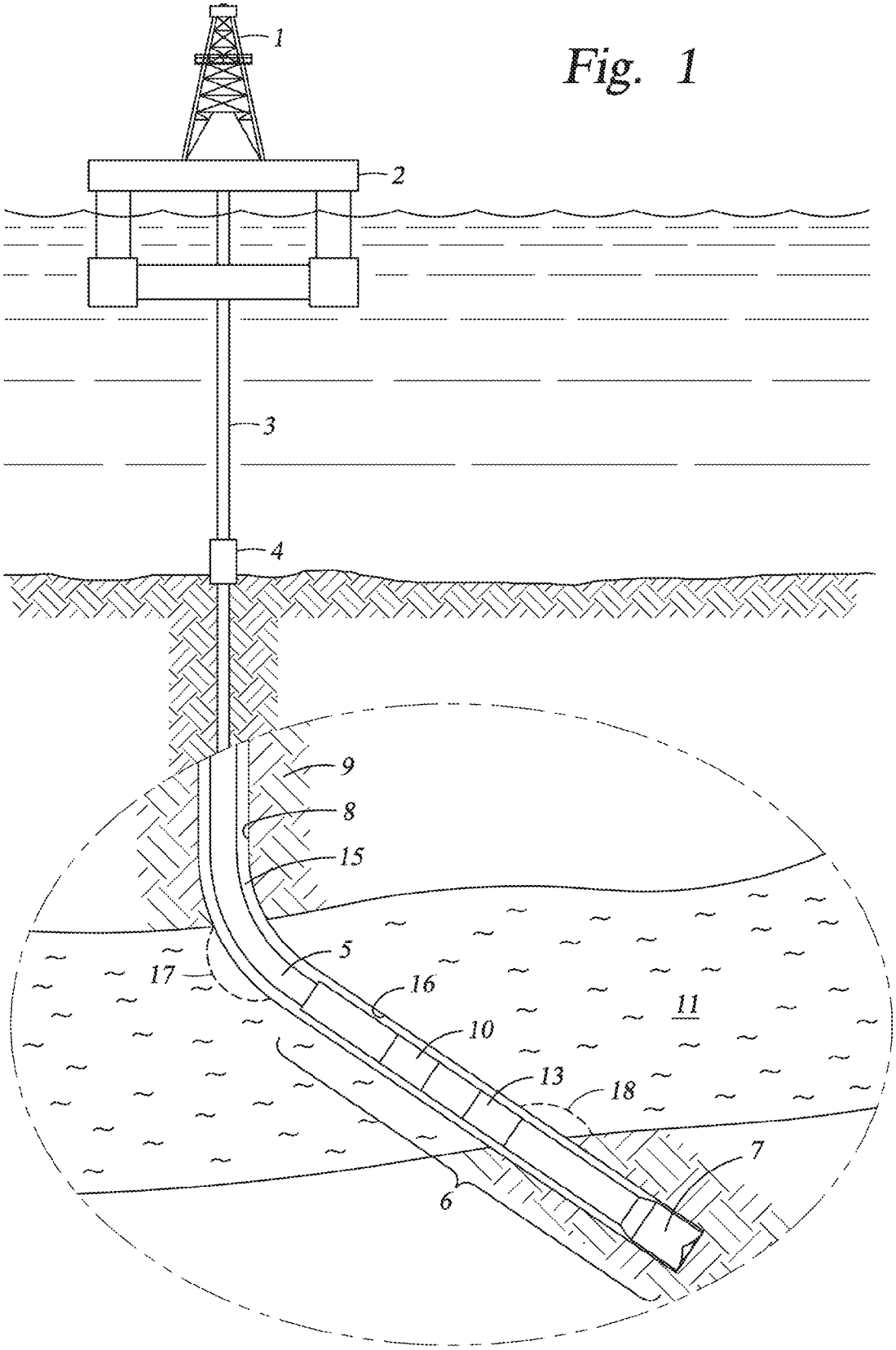
FIG. 1 is a schematic view, partly in cross-section, of a drilling system drilling an earthen borehole.

In the drawings and description that follow, like parts are typically marked throughout the specification and drawings with the same reference numerals. The drawing figures are not necessarily to scale. Certain features of the disclosure may be shown exaggerated in scale or in somewhat schematic form and some details of conventional elements may not be shown in the interest of clarity and conciseness. The present disclosure is susceptible to embodiments of different forms. Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed below may be employed separately or in any suitable combination to produce desired results.

In the following discussion and in the claims, the terms "including" and "comprising" are used in an open-ended fashion, and thus should be interpreted to mean "including, but not limited to . . . ". Unless otherwise specified, any use of any form of the terms "connect", "engage", "couple", "attach", or any other term describing an interaction between elements is not meant to limit the interaction to direct interaction between the elements and may also include indirect interaction between the elements described. Reference to up or down will be made for purposes of description with "up", "upper", "upwardly" or "upstream" meaning toward the surface of the well and with "down", "lower", "downwardly" or "downstream" meaning toward the terminal end of the well, regardless of the well bore orientation. In addition, in the discussion and claims that follow, it may be sometimes stated that certain components or elements are in "fluid communication" or are "fluidly coupled". By this it is meant that the components are constructed and interrelated such that a fluid could be communicated between them, as via a passageway, tube, or conduit. Generally, "drilling parameter" as used herein means any value, condition, operation or the like chosen and used by the drilling operator to drill or otherwise form the borehole. The various characteristics mentioned above, as well as other features and characteristics described in more detail below, will be readily apparent to those skilled in the art upon reading the following detailed description of the embodiments, and by referring to the accompanying drawings.

Referring initially to FIG. 1, a bottom hole assembly 6 coupled to a drillstring 5 is lowered from a drilling platform 2, such as a ship or other drilling platform. The drillstring 5 extends through a riser 3 and a well head 4. Drilling equipment is supported within and around a derrick 1 and rotates the drillstring 5 and a drill bit 7, causing the bit 7 to form a borehole 8 through the formation material 9. The volume defined between the drill string 5 and the borehole 8 is referred to as an annulus 15. The borehole 8 penetrates subterranean zones or reservoirs, such as reservoir 11, that are believed to contain hydrocarbons in a commercially viable quantity. It is also consistent with the teachings herein that the drillstring 5 and bottom hole assembly 6 are employed in other drilling systems, such as those for land-based drilling and land-based platforms.

Figure 2:
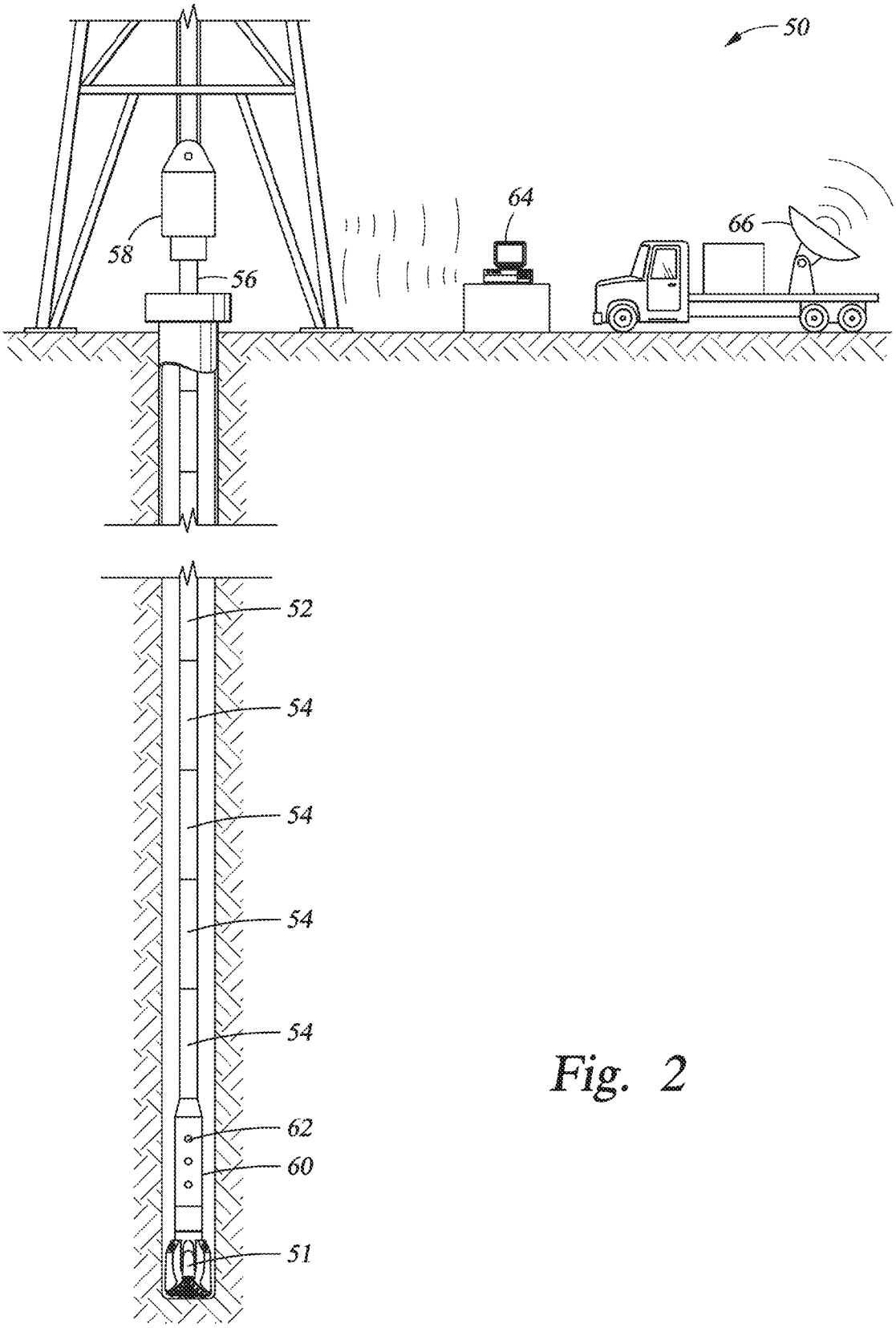
FIG. 2 is a schematic view, partly in cross-section, of a drilling system network with wired drill pipe.
Figure 3:
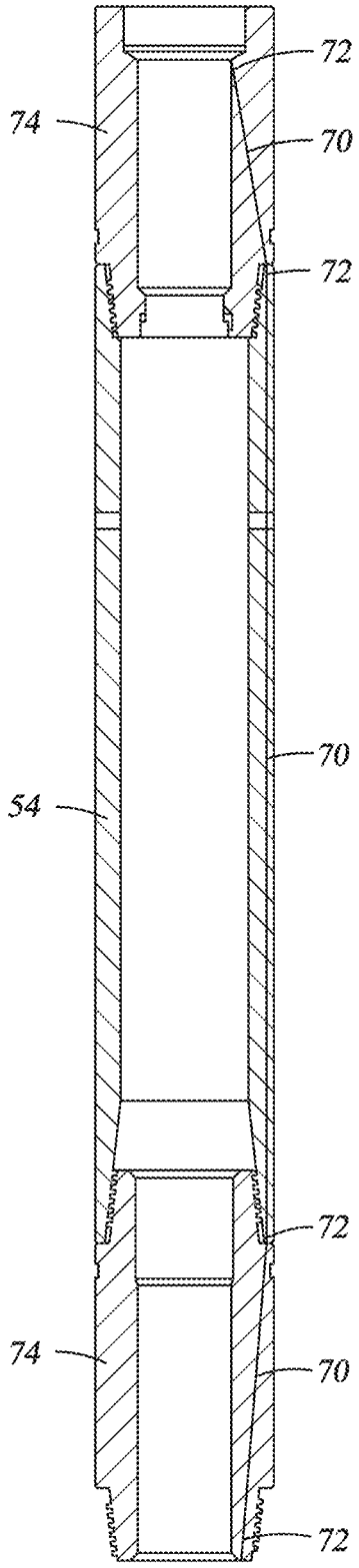
FIG. 3 is a cross-section view of a wired drill collar section of the drilling system network of FIG. 2.

In some embodiments, the measurement tool and bottom hole assembly may be part of a telemetry and/or electromagnetic network 50 with wired pipes, as shown in FIG. 2. In particular, in the embodiments of FIG. 2 measurement tool 60, just above a drill bit 51, is coupled to a drill string 52 formed by a series of wired drill pipes 54 connected for communication across junctions using communication elements as described below. It will be appreciated that drill string 52 can be other forms of conveyance, such as coiled tubing or wired coiled tubing. Other components of the network 50 comprise a Kelly 56, a top-hole repeater unit 58 to interface the network 50 with drilling control operations and with the rest of the world, a computer 64 in the rig control center to act as a server, and an uplink 66. The measurement tool 60 with sensors 62 is linked into the network 50 for communication along conductor pathways and along the wired drill string 52. As shown in FIG. 3, a pipe section 54 of the wired drill string 52 includes conductors 70 that traverse the entire length of the pipe section. Communication elements 72 allow the transfer of power and/or data between the pipe section 54 and other pipe components 74 such as subs, couplers and other pipes. A data/power signal may be transmitted along the pipe from one end of the tool through the conductor(s) 70 to the other end across the communication elements 72.

Referring back to FIG. 1, the bottom hole assembly 6 may include various instruments, tools, subs, and systems 10, 13, such as a down hole drill motor, a rotary steerable tool, a mud pulse telemetry system, measurement instruments, and other measurement while drilling (MWD) or logging while drilling (LWD) sensors and systems. For example, a measurement tool 10 may include a borehole diameter detector or LWD caliper for measuring the diameter of the borehole recently drilled by the drill bit 7. The caliper tool 10 is capable of recording multiple borehole diameter measurements as the caliper is moved axially along the borehole 8, in what is known as a log. The caliper log can be used to show continuity or changes in the borehole diameter over a chosen length of the borehole 8. In some circumstances, the borehole wall may become compromised and the borehole diameter enlarged. For example, as shown in FIG. 1, the borehole 8 reflects enlarged diameter portions 17, 18. The borehole 8 may be enlarged by mechanical interaction with the bottom hole assembly 6 or other portions of the drillstring 5, hydraulic damage from the bottom hole assembly 6, drilling or other circulating fluid that moves across and through the bottom hole assembly 6, insufficient drilling or other circulating fluid weight, excessive pressure or hydraulic horsepower per square inch (HSI) drop on the drill bit 7, excessive flow rate and/or viscosity of the drilling or circulating fluid, drillstring vibration, or a combination thereof.

Figure 4:
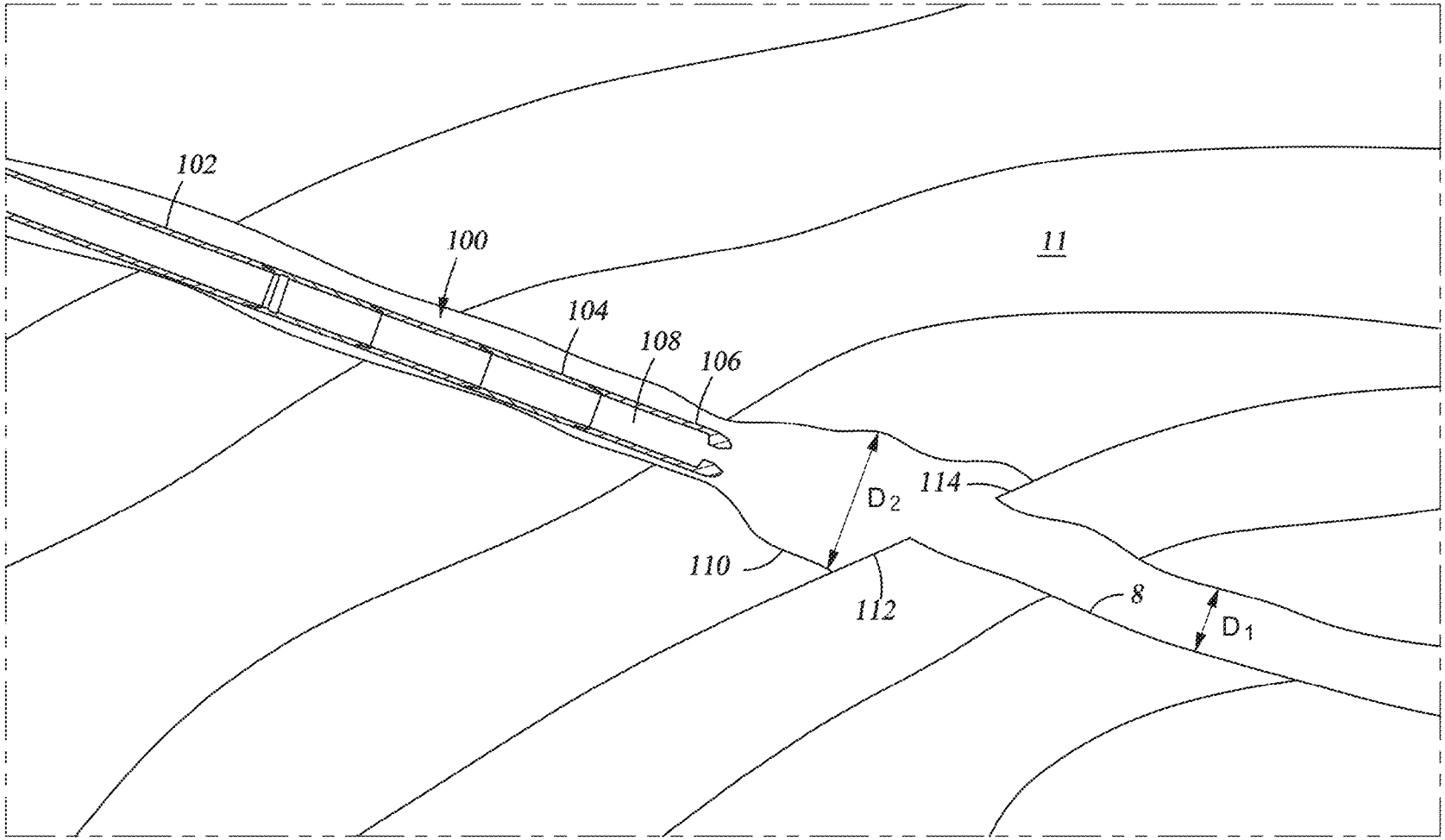
FIG. 4 is a cross-section view of a tubular string in a borehole and adjacent an enlarged diameter borehole portion.

When drilling a borehole for which borehole diameter enlargement occurs, the cause of the enlargement may first be identified before the enlargement may be addressed or mitigated. Referring now to FIG. 4, a tubular string 100, which may include the drillstring 5 or a casing string, is extended into the borehole 8 having an enlarged portion 110. The string 100 may include a primary portion 102 and a distal end portion 106. In the case where the string 100 is a drillstring, subs 104 may be disposed between portions 102, 106. A flow path extends through the tubular string 100. The difference between the primary borehole 8 diameter $D_1$ and the enlarged portion 110 diameter $D_2$ creates ledges or protrusions 112, 114 that interfere with proper running or tripping of the tubular string 100.

In some cases, manually measuring the amount of time spent drilling, reaming, or circulating over each identified stand or borehole interval across the entire drilled wellbore may allow correlation to the borehole diameter or caliper log. However, such a correlation is very time consuming and imprecise. Instead, as certain embodiments disclosed herein will illustrate, an automated method can be used to precisely measure the amount of mechanical and/or hydraulic damage from the bit or other cutting devices, or circulating well fluids, on each meter or other identified interval of the borehole wall, enabling a diagnosis of the sections of the borehole in which borehole diameter enlargements are associated with drilling, circulating, reaming, and/or cleaning the borehole. In certain methods and principles described herein, first, a correlation between a borehole diameter enlargement and a tripping and/or running problem of a tubular string is determined. Then, secondly, the cause or causes of the borehole diameter enlargement are determined. Finally, the borehole diameter enlargement problem is mitigated. Other methods disclosed below may include the aforementioned steps in a different order, and also may include additional steps.

Embodiments of a method are described herein to obtain a correlation between borehole diameter enlargements and tripping and/or running problems for the tubular string. For purposes of the following description, reference to tubular string includes drillstring, casing string, and other tubular strings affected by borehole enlargement. Further, embodiments of a method are described herein to determine the cause of the borehole diameter enlargement.

In certain embodiments, the LWD caliper 10 of FIG. 1 is operated in a standard manner to measure borehole diameter continually along its axial length, or along its depth. The measurements are recorded in a borehole diameter or caliper log, and the log is observed and analyzed. By analyzing multiple caliper logs of the same borehole interval or section, taken at different times, it can be observed how the borehole may enlarge with time. A first or "as-drilled" caliper log will generally reflect an in-gauge condition of the borehole section. A second caliper log can show borehole sections in which borehole enlargement is occurring. Further and subsequent caliper logs can show continued or extreme borehole diameter enlargements. If, during tripping or running of a tubular string, problems are experienced in the field with tight hold conditions or other interference with proper tubular string movement, then the problems can be correlated to the enlarged borehole diameter sections identified in the caliper logs. Such a correlation, however, does not explain the cause of the borehole diameter enlargements.

In certain embodiments of a method for diagnosing the cause or causes of borehole diameter enlargement, selected downhole drilling or operational parameters are identified and data related to same are gathered, manipulated, and analyzed. In some embodiments, a log of total bottom hole assembly (BHA, such as BHA 6 of FIG. 1) revolutions versus measured depth is created, to isolate this particular drilling parameter in the context of measured depth and identifiable sections of the borehole. First, the borehole is divided into measured depth (MD) bins. For example, each MD bin can be defined as one meter of MD. Second, the number of revolutions of the drill bit, such as the drill bit 7, executed over each MD bin along the borehole is measured. The measured drill bit revolutions are evaluated by numerically calculating $\int RPM\, dt$ for each MD bin [Equation 1] (wherein RPM=drill bit rotational speed, in revolutions per minute). The resulting string or curve from the calculation using Equation 1 is defined as the revolutions per meter (RM) value.

In further embodiments, a log of total pumped barrels versus depth is created. First, the same MD bins as defined above are used. Second, the volume of drilling fluid or mud that is pumped through the drill bit 7 over each MD bin along the borehole is measured. For example, the number of barrels of drilling mud pumped through the drill bit 7 is counted. The measured drilling mud pumped volume is evaluated by numerically calculating ∫BPM dt for each MD bin [Equation 2] (wherein BPM=flow rate, in barrels per minute). The resulting string or curve from the calculation using Equation 2 is defined as the pumped barrels per meter (BM) value.

Calculations from Equations 1 and 2 are performed and the resulting RM and BM curves are recorded from the beginning of the drilling operations up to the time the borehole diameter is measured with the caliper. Thus, all mechanical and hydraulic damage is accounted for, including damage caused by the drilling operation as well as the reaming and circulating operations. Consequently, the RM and BM curves each include a baseline period (from drilling revolutions and barrels pumped, respectively) which are functions of drilling rate of penetration (ROP), RPM, and BPM. Furthermore, the borehole diameter can be compared to mechanical and hydraulic damage created up to the time that the borehole diameter is measured. For example, it may not be useful to compare the borehole diameter measured while-drilling with the corresponding RM and BM curves which include reaming and back-reaming operations. Still further, the calculated RM and BM curves can be plotted and compared with the caliper log curves.

Figure 5:
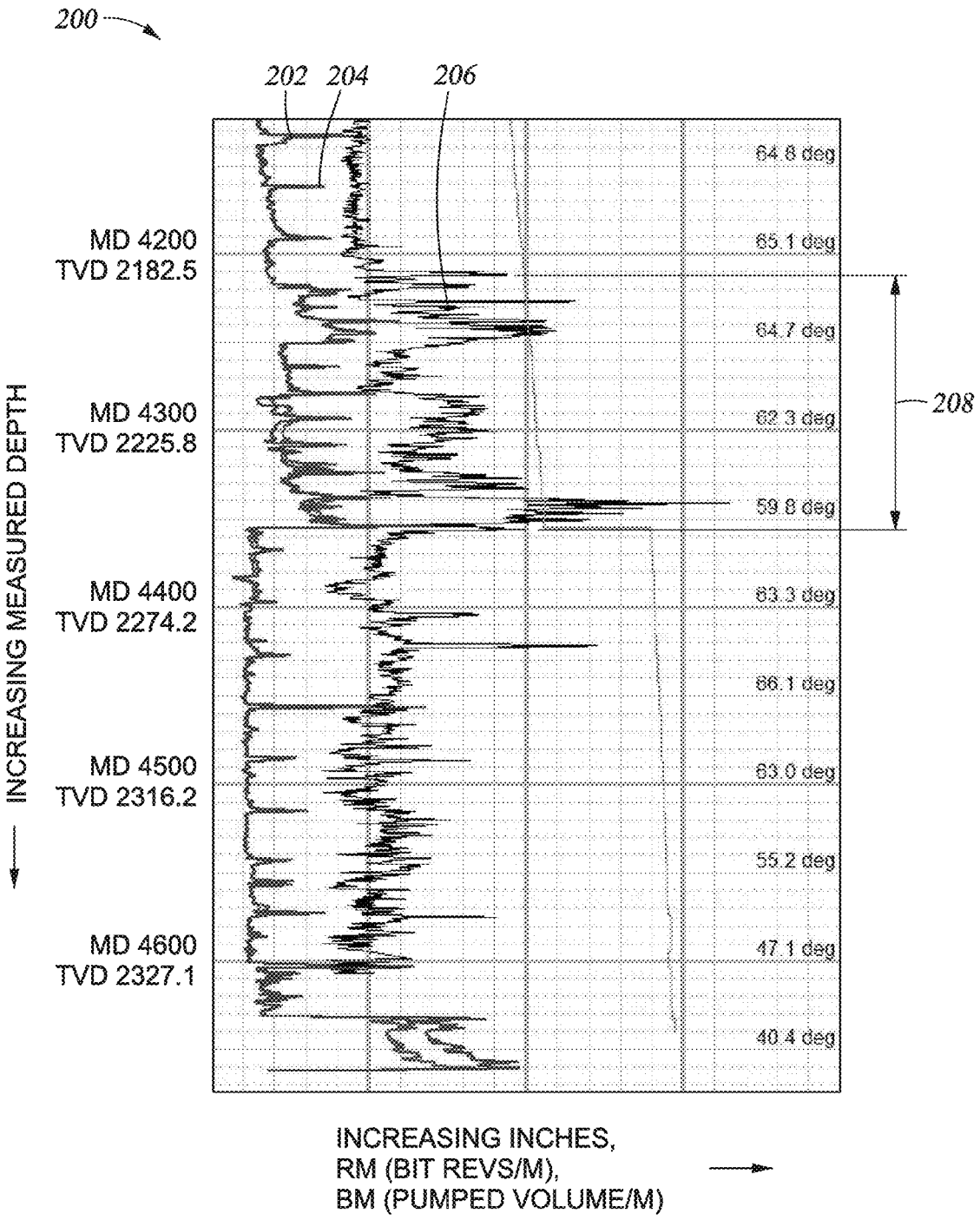
FIG. 5 is a graph plotting drilling parameter curves and a borehole diameter curve.
Figure 6:
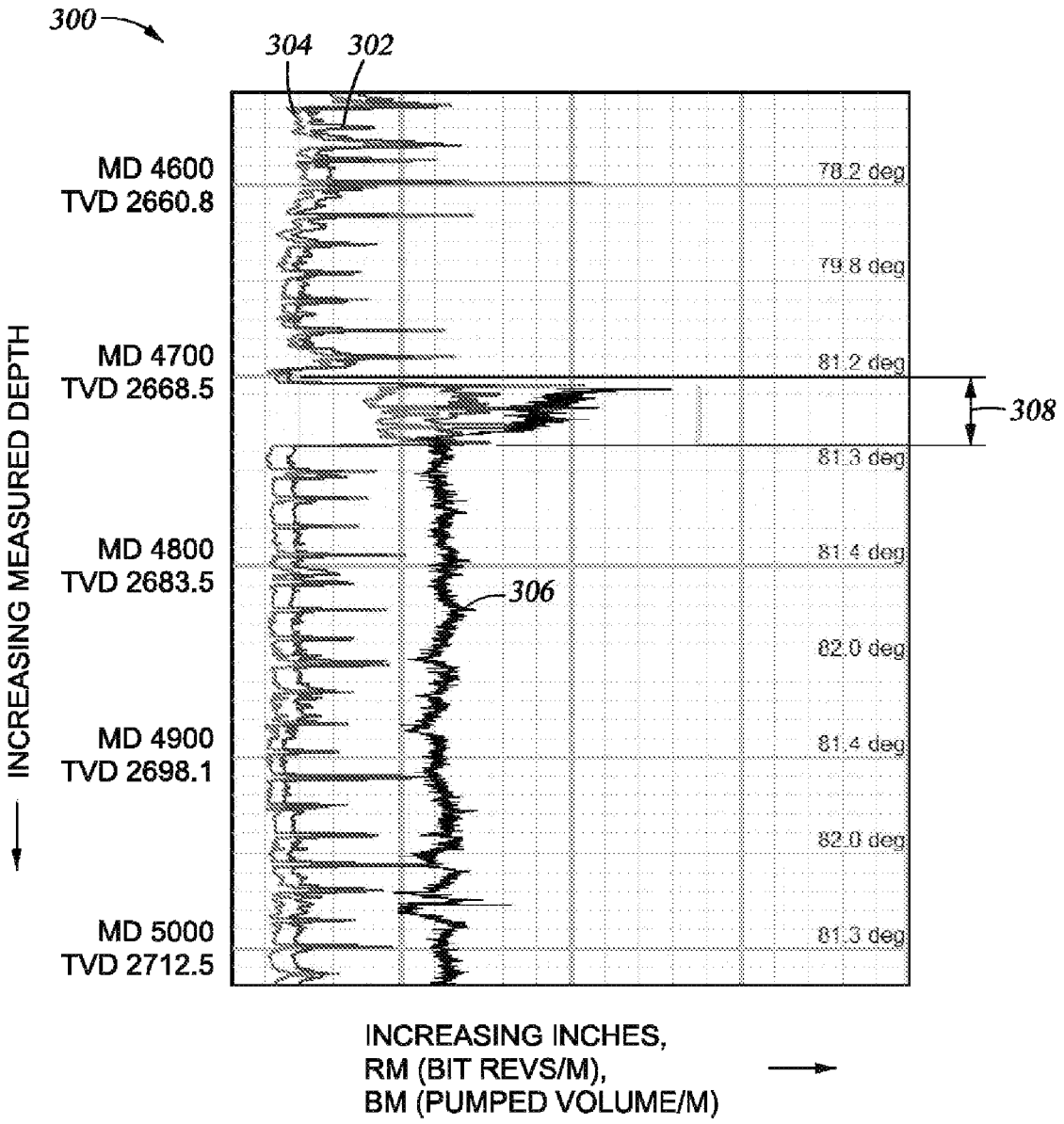
FIG. 6 is another graph plotting drilling parameter curves and a borehole diameter curve.

Referring now to FIGS. 5 and 6, the RM and BM curves can be plotted next to a caliper log curve, more generally referred to as a borehole diameter curve, for comparison. In FIG. 5, a graph 200 includes a RM curve 202, a BM curve 204 and a caliper curve 206. As shown over the interval 208, increases in the RM and BM values match with an increase in the borehole diameter. Thus, a correlation is made between the RM and BM drilling parameters and the enlarged borehole diameter. In some embodiments, such a correlation indicates that the borehole diameter enlargement was caused by excessive reaming and/or circulating over the interval 208, such as during a cleaning portion of the drilling operation. In FIG. 6, a graph 300 includes a RM curve 302, a BM curve 304 and a caliper curve 306. As with the curves in FIG. 5, a strong correlation is shown between the RM and BM curves 302, 304 and the caliper curve 306, particularly at interval 308. An increase in the RM and BM values matches with an increase in the borehole diameter (at the interval 308). Thus, the correlation indicates that the borehole diameter enlargement was caused by the mechanical and hydraulic damage from the RM and BM increases due to certain drilling practices such as, for example, excessive reaming and/or circulating.

In some embodiments, wherein the RM and BM curves do not match with the caliper curve, the correlation between the corresponding drilling parameters and the borehole diameter enlargement cannot be made with certainty. For example, if the RM and BM curves reflected increases in the RM and BM values, but the caliper curve showed no increase in the borehole diameter or an increase in the borehole diameter at a different depth from the RM and BM increases, then increases in the RM and BM values and the resulting mechanical and hydraulic damage to the borehole cannot be said to be a cause of borehole diameter enlargement with certainty.

It is understood that either one of the RM or BM curves, rather than both, may be plotted against the caliper curve and the same analysis performed as above. In other words, in some embodiments, just one drilling parameter curve is used to compare and correlate to the caliper curve. Similarly, the one or more drilling parameter used in the curve comparison may include various other drilling parameters. For example, the drilling parameter may include the number of BHA stabilizers, drill bit and/or stabilizer side forces (wherein ton-.revs are accumulated for each measured depth bin, similar to ton.milles used to account for drill line wear), mass flow rate, annular velocity, and others. Curves can be plotted, according to the principles taught herein, for one or more of the above drilling parameters in various combinations to compare and correlate to the caliper curve of the borehole diameter.

In some embodiments, once a correlation is made between a certain operational or drilling parameter or parameters and an enlarged borehole diameter, and the cause of borehole enlargement is determined, certain corrective actions or adjustments may be taken in response to mitigate the borehole enlargement. For example, if a correlation between RPM and borehole enlargement is determined as described above, the enlargement can be mitigated by reducing RPM or increasing ROP to reduce the number of revolutions of the drill bit 7 for every depth bin. In other embodiments, if a correlation between BPM and borehole enlargement is determined as described above, the enlargement can be mitigated by reducing BPM or, again, increasing ROP to reduce the number of barrels pumped for every depth bin. As described, RPM and BPM may both be addressed if both of these drilling parameters are correlated to borehole enlargement. In still further embodiments, corrective actions or adjustments may also be made with respect to the other operation or drilling parameters listed in the preceding paragraph.

In some embodiments, additional indications or conditions may be gleaned or determined from the methods and processes described above. In one embodiment, if the RM and/or BM values such as those shown in FIGS. 5 and 6 are at a level where borehole enlargement might be expected, such as at elevated levels or levels comparable to sections with borehole enlargement, the lack of significant borehole enlargement may indicate that the corresponding borehole interval includes strong, competent rock.

In further embodiments, the methods and processes described herein can be used to identify possible problem zones when borehole diameter is not available. If the RM and/or BM curves such as those shown in FIGS. 5 and 6 are at elevated levels over a particular interval, but borehole diameter information is not known, borehole enlargement problems may still be expected if drilling is continued beyond that interval. Interference is possible when tripping over that interval as a result of possible borehole enlargement.

In some embodiments, the equations, calculations, and associated processes and methods as described above are implemented using a Microsoft Excel® spreadsheet. In other embodiments, they are implemented using field software such that the data and results are available in real time while the well is being drilled. In certain embodiments, the equations and calculations are embedded in InSite® software and the data, processes and methods as described herein are manipulated by same. The borehole diameter measurement data, and the drilling parameter data, can be communicated to the surface of the well using telemetry or other standard communication methods through the well, or the network 50 of FIG. 2. The surface equipment, such as that shown in FIG. 2 and including the computer 64, can be used to implement the software as described above.

Figure 7:
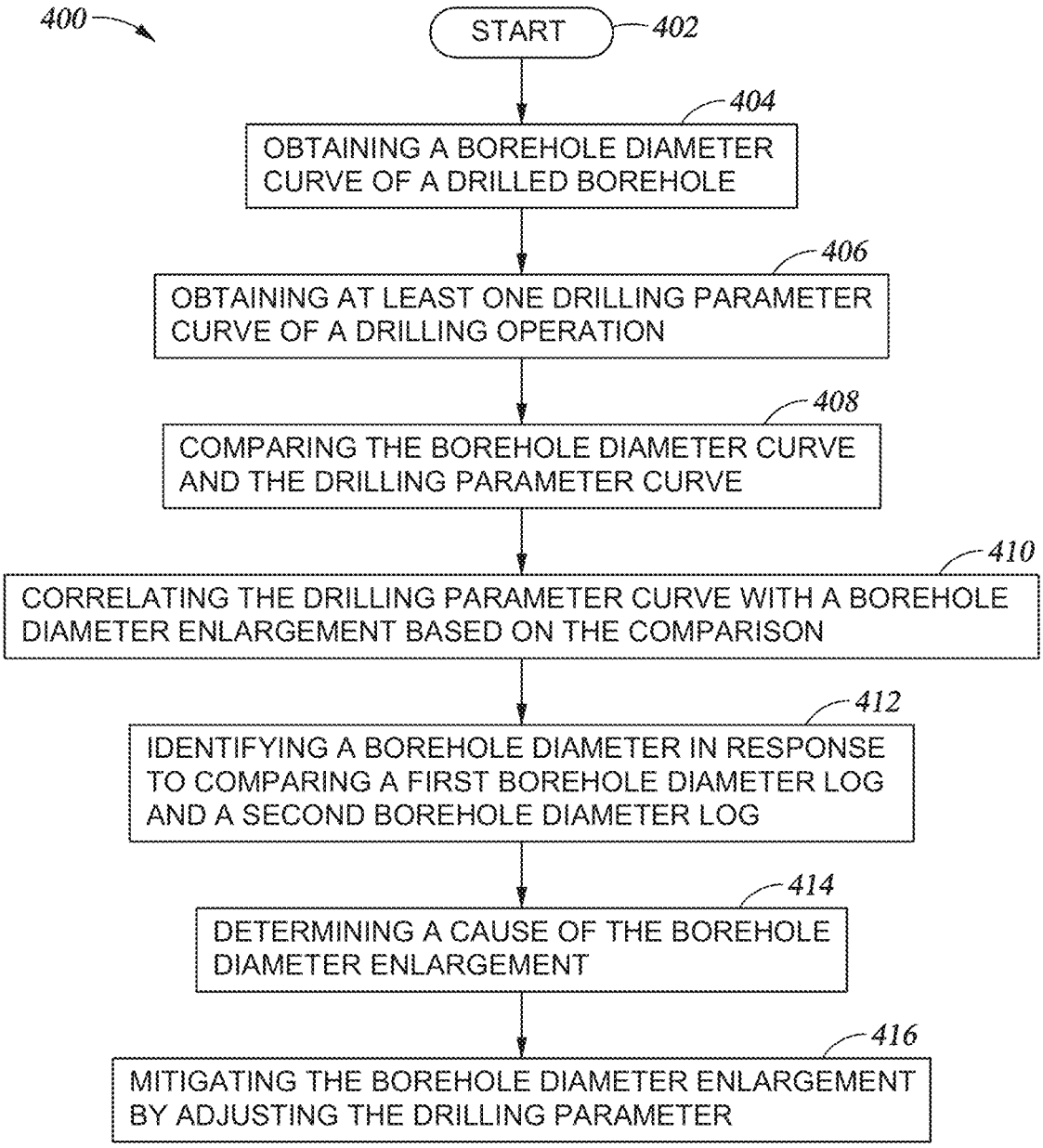
FIG. 7 is a flow chart illustrating an embodiment of a method in accordance with the principles disclosed herein.

Referring now to FIG. 7, a method 400 of detecting and mitigating borehole diameter enlargement is illustrated with a flow chart. At box 404, a borehole diameter curve of a drilled borehole is obtained. Then, at least one drilling parameter curve of a drilling operation is obtained, at box 406. The borehole diameter curve is compared to the drilling parameter curve, at box 408. Next, the drilling parameter is correlated with a borehole diameter enlargement based on the comparison, at box 410. The method may also include identifying a diameter enlargement of the borehole in response to comparing a first borehole diameter log and at least a second borehole diameter log, at box 412. At box 414, the method may include determining a cause of the borehole diameter enlargement. At box 416, the method may include reducing or mitigating the borehole diameter enlargement by adjusting the drilling parameter.

Figure 8:
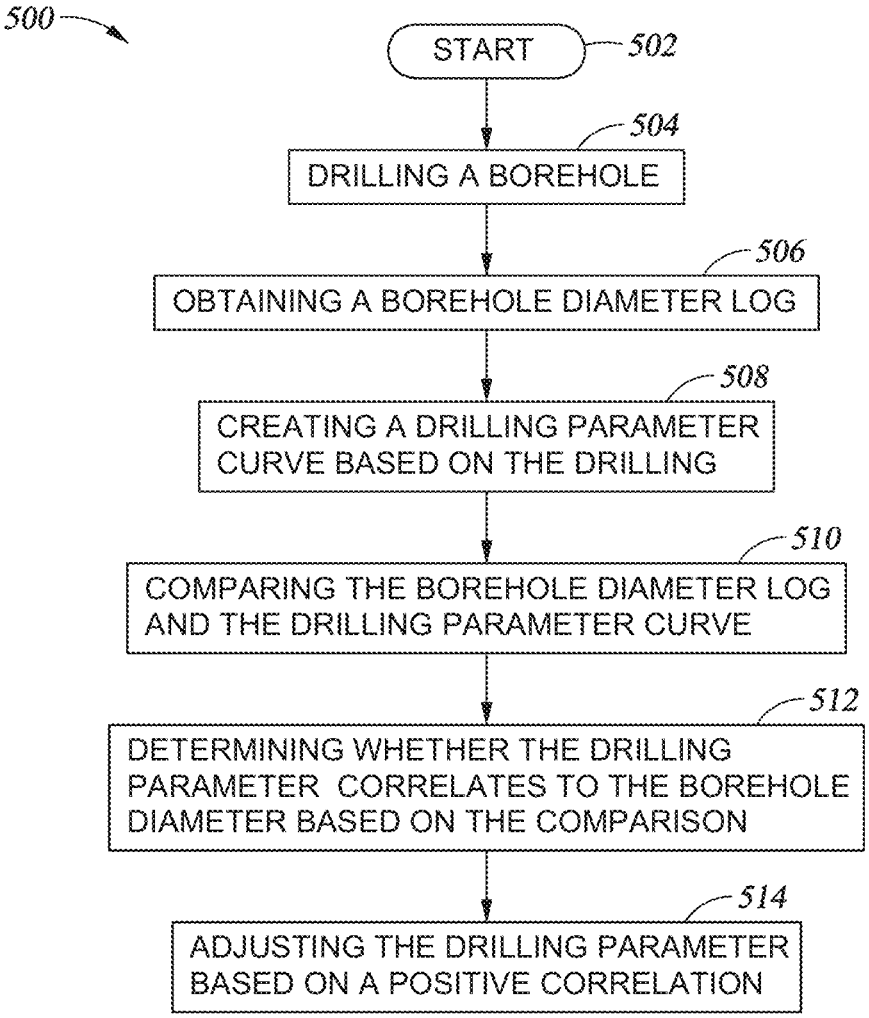
FIG. 8 is a flow chart illustrating another embodiment of a method in accordance with the principles disclosed herein.

Referring now to FIG. 8, a method 500 of detecting and mitigating borehole diameter enlargement is illustrated with a flow chart. At box 504, a borehole is drilled. At box 506, a borehole diameter log of the drilled borehole is obtained. Then, the method includes creating a drilling parameter curve based on the drilling the borehole, at box 508. Next, the method includes comparing the borehole diameter log and the drilling parameter curve, at box 510. The method includes determining whether the drilling parameter correlates to the borehole diameter based on the comparing step, at box 512, and adjusting the drilling parameter based on a positive correlation, at box 514. In some embodiments, the drilling parameter curve is a RM curve and/or a BM curve. In some embodiments, the adjustment may include increasing ROP, decreasing RPM, decreasing the flow rate or BPM, reducing circulating, reducing reaming, or a combination thereof. As previously described, in some embodiments, a negative correlation is made when a change in the drilling parameter does not match with a change in the borehole diameter.

Figure 9:
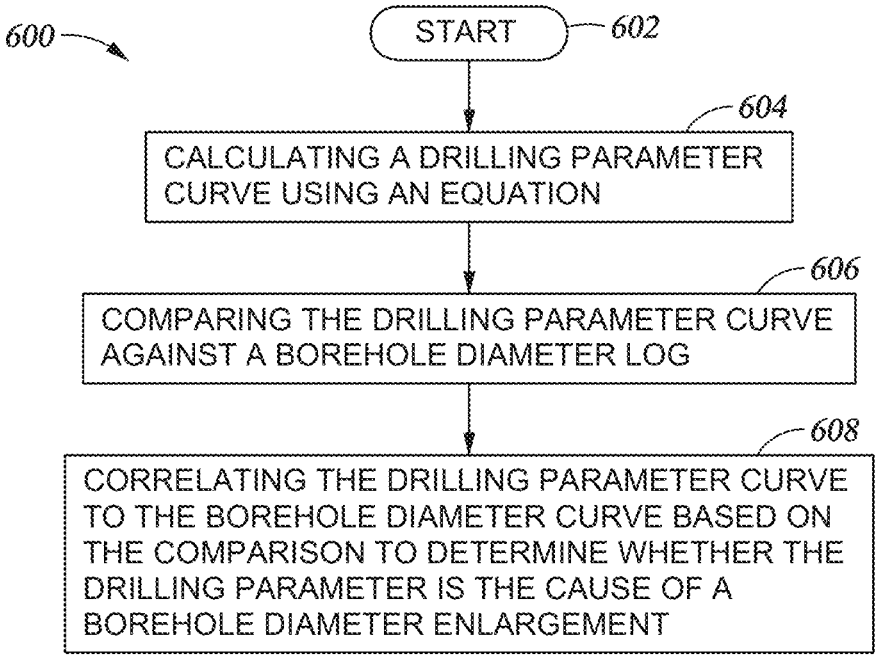
FIG. 9 is a flow chart illustrating a further embodiment of a method in accordance with the principles disclosed herein.

Referring now to FIG. 9, a method 600 of detecting and mitigating borehole diameter enlargement is illustrated with a flow chart. At box 604, the method includes calculating a drilling parameter curve using an equation. At box 606, the method includes comparing the drilling parameter curve against a borehole diameter log, and then correlating the drilling parameter curve to the borehole diameter curve based on the comparing to determine whether the drilling parameter is the cause of a borehole diameter enlargement, at 608.

Based on the principles taught herein, a system for detecting and mitigating borehole diameter enlargement may include a drillstring having a bottom hole assembly, a LWD caliper, and a drill bit for drilling a borehole, as shown in FIG. 1. The system may further include a computer including software for receiving borehole diameter data and drilling parameter data, the computer including an equation for calculating a drilling parameter curve, as shown in FIG. 2 and described with respect to FIG. 2 and elsewhere herein. Further, the system includes that the software is configured to record a borehole diameter curve and calculate a drilling parameter curve using the equation, and to compare the borehole diameter curve and the drilling parameter curve and correlate the drilling parameter with a borehole diameter enlargement based on the comparison. In some embodiments, the system is configured such that the drilling parameter is adjustable based on the correlation.

Borehole diameter enlargement creates drilling and casing problems. Borehole enlargement can be caused by mechanical and/or hydraulic damage from the BHA and drilling mud across the BHA. Presented herein is an automated method to precisely measure the amount of mechanical and hydraulic damage from the bit on each meter of the borehole wall, enabling a diagnosis of the sections of the well in which the enlargements are associated with drilling, reaming, circulating, and/or cleaning. The methods and processes presented herein can be used to precisely measure the amount of mechanical and hydraulic damage from reaming, circulating, and slow drilling operations along the borehole, thereby enabling identification of the sections of the well in which the hole enlargement problem is associated with these operations. These analyses can be performed in real time and in post-run processes.

In certain embodiments, and as previously described, certain remedial actions or adjustments may be executed based on the diagnoses of borehole enlargement. For example, drilling practices can be changed to adjust, or increase, ROP. Further, the revolutions or volume of fluid pumped per unit length of the borehole can be controlled to achieve good in-gauge condition of the borehole and also good cleaning. In one example, "fast" drilling, with an exemplary ROP of about 90 m/h, may produce low RM and BM values. Further, in some embodiments, reaming and circulating may be reduced or eliminated. As a result, the borehole may remain relatively in-gauge, thereby making cleaning easier even without the original drilling parameters.

In certain embodiments, a method of detecting and mitigating borehole diameter enlargement includes obtaining a borehole diameter curve of a drilled borehole, obtaining at least one drilling parameter curve of a drilling operation, comparing the borehole diameter curve and the drilling parameter curve, and correlating the drilling parameter with a borehole diameter enlargement based on the comparison. In some embodiments, the method includes determining whether the drilling parameter correlates to the borehole diameter based on the comparison, which may include a positive correlation or a negative correlation. The method may further include obtaining a first borehole diameter log of a borehole section while drilling the borehole, then obtaining at least a second borehole diameter log of the borehole section, comparing the first log and the second log, and identifying a diameter enlargement of the borehole in response to the comparing. The method may include determining a cause of the borehole diameter enlargement. The determining step may be based on the comparison of the borehole diameter curve and the drilling parameter curve. In some embodiments, the drilling parameter curve is an RM curve created using Equation 1. In some embodiments, the drilling parameter curve is a BM curve created using Equation 2.

In some embodiments, the method further includes reducing the borehole diameter enlargement by adjusting the drilling parameter. The adjusting may include increasing ROP, decreasing circulating (time), decreasing reaming (time), or a combination thereof.

In certain embodiments, a method of detecting and mitigating borehole diameter enlargement includes drilling a borehole, obtaining a borehole diameter log of the drilled borehole, creating a drilling parameter curve based on the drilling the borehole, comparing the borehole diameter log and the drilling parameter curve, correlating the drilling parameter to the borehole diameter based on the comparing, and adjusting the drilling parameter based on the correlating. In some embodiments, the drilling parameter is revolutions of a drill bit. In some embodiments, the drilling parameter curve is created using a revolutions per meter (RM) value calculated using Equation 1. In some embodiments, the drilling parameter is pumped barrels of drilling fluid. In some embodiments, the drilling parameter curve is created using a pumped barrels per meter (BM) value calculated using Equation 2. In some embodiments, the adjusting the drilling parameter includes increasing ROP, decreasing circulating (time), decreasing reaming (time), decreasing RPM, decreasing BPM, or a combination thereof.

In some embodiments, a method of detecting and mitigating borehole diameter enlargement includes calculating a drilling parameter curve using an equation, comparing the drilling parameter curve against a borehole diameter log, and correlating the drilling parameter curve to the borehole diameter curve based on the comparison to determine whether the drilling parameter is the cause of a borehole diameter enlargement.

In some embodiments, a system for detecting and mitigating borehole diameter enlargement includes a drillstring having a bottom hole assembly, a LWD caliper, and a drill bit for drilling a borehole, and a computer including software for receiving borehole diameter data and drilling parameter data, the computer including an equation for calculating a drilling parameter curve, wherein the software is configured to record a borehole diameter curve and calculate a drilling parameter curve using the equation, and to compare the borehole diameter curve and the drilling parameter curve and correlate the drilling parameter with a borehole diameter enlargement based on the comparison. In some embodiments, the drilling parameter is adjustable based on the correlation.

The embodiments set forth herein are merely illustrative and do not limit the scope of the disclosure or the details therein. It will be appreciated that many other modifications and improvements to the disclosure herein may be made without departing from the scope of the disclosure or the inventive concepts herein disclosed. Because many varying and different embodiments may be made within the scope of the inventive concept herein taught, including equivalent structures hereafter thought of, and because many modifications may be made in the embodiments herein detailed in accordance with the descriptive requirements of the law, it is to be understood that the details herein are to be interpreted as illustrative and not in a limiting sense.

What is claimed is:

1. A method of detecting and mitigating borehole diameter enlargement comprising:

obtaining a borehole diameter curve indicative of a diameter of a drilled borehole at each of a plurality of depth bins along a length of the drilled borehole;

obtaining at least one drilling parameter curve indicative of a drilling parameter of a drilling operation at each of the plurality of depth bins along the length of the drilled borehole;

comparing the borehole diameter curve and the drilling parameter curve;

correlating the drilling parameter with a borehole diameter enlargement based on the comparison, wherein the borehole diameter enlargement comprises a portion of the drilled borehole having enlarged diameter with respect to a primary portion of the drilled borehole.

2. The method of claim 1 further comprising:

obtaining a first borehole diameter log of a borehole section while drilling the borehole;

then obtaining at least a second borehole diameter log of the borehole section;

comparing the first log and the second log; and identifying a diameter enlargement of the borehole in response to the comparing.

3. The method of claim 1 further comprising determining a cause of the borehole diameter enlargement.

4. The method of claim 3 wherein the determining is based on the comparison of the borehole diameter curve and the drilling parameter curve.

5. The method of claim 1 further comprising reducing the borehole diameter enlargement by adjusting the drilling parameter.

6. The method of claim 5 wherein the adjusting the drilling parameter includes increasing rate of penetration, decreasing circulating (time), decreasing reaming (time), or a combination thereof.

7. The method of claim 1 wherein the drilling parameter is distinct from the diameter of the drilled borehole.

8. The method of claim 7 wherein the drilling parameter distinct from the diameter of the drilled borehole comprises at least one of the group consisting of: a force value, a mass flow rate, an angular velocity, a rate of penetration, a time value, a number of revolutions value, and a volumetric value.

9. The method of claim 8 wherein the drilling parameter is a number of revolutions value calculated by integrating a drill bit rotational speed over time.

10. The method of claim 8 wherein the drilling parameter is a volumetric value calculated by integrating a drilling mud flow rate over time.

11. The method of claim 1 wherein comparing the borehole diameter curve and the drilling parameter curve comprises identifying a depth interval over which a change the borehole diameter matches a change in the drilling parameter.

12. A method of detecting and mitigating borehole diameter enlargement comprising:

obtaining a borehole diameter curve indicative of a diameter of a drilled borehole at each of a plurality of depth bins along a length of the drilled borehole;

obtaining at least one drilling parameter curve indicative of a revolutions per meter (RM) value of a drilling operation at each of the plurality of depth bins along the length of the drilled borehole, wherein the drilling parameter curve is an RM curve, and wherein the RM values are calculated from a drill bit rotational speed in revolutions per minute (RPM) by the equation: $RM=\int RPM\ dt$;

comparing the borehole diameter curve and the drilling parameter curve;

correlating the drilling parameter with a borehole diameter enlargement based on the comparison; and determining a cause of the borehole diameter enlargement based on the comparison of the borehole diameter curve and the drilling parameter curve.

* * * * *